US005752908A

United States Patent [19]

Derby

[11] Patent Number: 5,752,908

[45] **Date of Patent: *May 19, 1998**

[54] METHOD OF MANUFACTURE OF A GLUED TOP AND BOTTOM BULK CONTAINER

[75] Inventor: Norwin C. Derby, Dallas, Tex.

[73] Assignee: Super Sack Mfg. Corp., Dallas, Tex.

[ * ] Notice: The portion of the term of this patent subsequent to Dec. 2, 2013, has been disclaimed.

[21] Appl. No.: 594,263

[22] Filed: Jan. 30, 1996

Related U.S. Application Data

[63] Continuation of Ser. No. 566,076, Dec. 1, 1995, which is a continuation of Ser. No. 160,229, Dec. 2, 1993, Pat. No. 5,490,828.

[51] Int. Cl.[6] ..... B31B 47/00; B31B 1/62; B31B 49/04

[52] U.S. Cl. ..... 493/220; 493/210; 493/267

[58] Field of Search ..... 493/84, 87, 102, 493/86, 210, 212, 213, 220, 783, 227, 231, 243, 252, 253, 260, 261, 267, 105, 106–108, 926, 927, 226

[56] References Cited

U.S. PATENT DOCUMENTS

| | | | |
|---|---|---|---|
| 2,221,617 | 11/1940 | Steen . | |
| 2,929,544 | 3/1960 | Herschler . | |
| 4,133,280 | 1/1979 | Takatori et al. | 112/121.15 |
| 4,143,796 | 3/1979 | Williamson . | |
| 4,194,652 | 3/1980 | Williamson . | |
| 4,221,250 | 9/1980 | Manerba | 493/212 |
| 4,365,459 | 12/1982 | Grundler | 493/252 |
| 4,457,456 | 7/1984 | Derby . | |
| 4,479,243 | 10/1984 | Derby et al. | 493/210 |
| 4,493,109 | 1/1985 | Nattrass | 493/926 |
| 4,664,044 | 5/1987 | Gazzarrini | 112/121.15 |
| 4,759,473 | 7/1988 | Derby | 222/105 |
| 4,903,589 | 2/1990 | Derby | 220/462 |
| 4,927,075 | 5/1990 | Lisiecki | 493/183 |
| 5,110,037 | 5/1992 | Pieritz, Sr. | 493/183 |
| 5,127,893 | 7/1992 | Lafleur | 493/226 |
| 5,230,689 | 7/1993 | Derby | 493/210 |
| 5,244,280 | 9/1993 | Porter et al. | 493/226 |
| 5,490,828 | 2/1996 | Derby | 493/220 |

FOREIGN PATENT DOCUMENTS

| | | | |
|---|---|---|---|
| 24 57 533 | 8/1975 | Germany | 493/252 |
| 1 385 286 | 2/1975 | United Kingdom | 493/252 |

*Primary Examiner*—Joseph J. Hail, III
*Assistant Examiner*—Christopher W. Day
*Attorney, Agent, or Firm*—Michael A. O'Neil; Russell N Rippamonti

[57] ABSTRACT

A process for the construction of a flexible bulk container including a glued bottom portion and/or a glued top portion. A sidewall blank having a hollow tubular configuration with an upper and lower portion suspended in the shape of the desired container and positioned over a bottom wall located on a raised work area. Adhesive or glue is applied to either the bottom wall and/or the sidewall in areas where the sidewall blank will be permanently in contact with the bottom wall. The sidewall blank is lowered into contact with the bottom wall such that the lower portion of the sidewall blank is located below the work area and the upper portion is located above the work area. The sidewall blank is secured to the bottom wall by folding the upper portion of the sidewall blank over the bottom wall thereby contacting the adhesive or glue and forming a glued bottom bag.

4 Claims, 11 Drawing Sheets

METHOD OF MANUFACTURE OF A GLUED TOP AND BOTTOM BULK CONTAINER

RELATED APPLICATIONS

This application is a continuation-in-part application under 37 C.F.R. §1.53 of pending application Ser. No. 08/566,076 filed Dec. 1, 1995, currently pending, which is a continuation of application Ser. No. 08/160,229 filed Dec. 2, 1993, now U.S. Pat. No. 5,490,828.

TECHNICAL FIELD

This invention relates to flexible bulk containers and, more particularly, to bulk containers having a glued top and/or bottom and process for manufacturing the same.

BACKGROUND OF THE INVENTION

Historically, flexible bulk containers have been used for receiving, storing, transporting and discharging flowable materials of all types. The containers are typically constructed in a square, vertically rectangular or circular shape with lift straps attached to each of the uppermost corners of the square, rectangle or circle.

By way of example, the flexible bulk containers are used for handling granular, liquid or powder (flowable) materials such as chemicals, minerals, fertilizers, foodstuffs, grains and agricultural products. The advantages of such receptacles include relatively low weight, reduced cost, versatility and, in the case of reusable receptacles, low return freight costs.

At the present time most flexible bulk containers are manufactured from woven polypropylene fabric. Typically, such containers are constructed by stitching or sewing together two or more sidewalls and a bottom portion. Optionally, a top portion, lift straps or other structural support can be added to this basic construction. The traditional method of securing the seams of the several portions of the container includes sewing or stitching, a time-consuming, labor-intensive and therefore expensive process. Usually, attachment of the bottom portion to the remaining piece or pieces, a critical step in the manufacture of a container, consumes the most time, labor and expense. Thus a need has arisen for a method of construction of a container wherein the bottom and/or top panel is quickly, easily and inexpensively attached to the container.

Furthermore, needle holes created in the stitching process allow powdered materials to sift through the holes. Thus a need has arisen for a method of construction of a container that does not use conventional stitching for the bottom seams and/or top seams.

In order to meet the need for construction of a container wherein the bottom panel is quickly, easily and inexpensively attached to the container and there are no needle holes at the bottom seam, Applicant has filed application Ser. No. 08/160,229, now U.S. Pat. No. 5,490,828; divisional application Ser. No. 08/536,217; and application Ser. No. 08/566,076 (filed Dec. 1, 1995) for glued bottom containers.

However, for the same reasons discussed above, a need continues to exist for a glued top container. It is not possible to simply apply the teachings of the Applicant's above-mentioned pending applications as, once a bottom is affixed to the sidewall of an open top container, it is not possible to lower the open top container over a top resting on a work table, because the previously affixed bottom wall precludes such a procedure.

SUMMARY OF THE INVENTION

The instant invention overcomes the foregoing and other problems associated with the prior art by providing a method of construction of a container wherein the top and bottom walls of the container are quickly, easily and inexpensively secured to the container.

According to the teaching of the aforementioned patent applications, a sidewall blank may be constructed by securing one or more sidewalls together to form a container lacking a top and a bottom. Alternatively, a circular woven fabric tube may function as the sidewall blank. For purposes of this application, the term "sidewall blank" means containers lacking a top wall and a bottom wall and constructed from either a single sheet of material or any number of sidewalls secured together, or a circular woven tube. In this application, when referring to a sidewall blank, the "upper portion of the sidewall blank" means the upper most section of the sidewall when the sidewall blank is vertically upright and viewed from the side. For purposes of this application, the term "Glue Bottom Bag" means a container constructed by one of the six embodiments hereinafter disclosed.

In a first embodiment of the invention, the Glue Bottom Bag has an octagonal horizontal cross section. A single sheet of material of rectangular shape has the top cut in a saw tooth manner in a series of eight isosceles triangles spaced equally along the top. Alternatively, eight individual sidewalls may be secured together to form a single sheet with the isosceles triangles again spaced along the top. The rectangular sheet is formed into the sidewall blank having an open top and open bottom by bringing two opposing ends together and securing them to each other in a conventional manner. The isosceles triangles are positioned along the upper portion of the sidewall blank.

Next, the sidewall blank is attached to a carriage and suspended over an octagonal work table by a structural support. The structural support includes a raised work platform designed to place a worker in an optimum position for attaching the bottom wall to the sidewall blank to form a container. From the raised work platform, a worker can secure the sidewall blank to the carriage, position the sidewall blank over the work table and perform the steps necessary to secure the bottom wall to the sidewall blank to form a container. The work table includes a hole at its center so that an access opening, if any, located in the bottom wall can be accommodated during the construction process.

Since the sidewall blank lacks a top wall and a bottom wall at this stage in the construction, the carriage of the structural support includes outwardly-movable support arms capable of supporting the sidewall blank by stretching the flexible material of the sidewall blank into the shape of an octagon or square. The opposing force of the support arms at the sides of the sidewall blank simultaneously supports the sidewall blank and shapes the sidewall blank for receiving the bottom wall.

In the next step of the process, an octagonal bottom wall is positioned on the work table beneath the suspended sidewall blank. Adhesive or glue is then applied to the bottom wall in areas which will come into contact with the sidewall blank.

Subsequent to placement of the adhesive or glue, the sidewall blank is lowered into contact with the bottom wall. The length of the sidewall blank is then draped down and over the work table so that the upper portion of the sidewall blank which will contact the adhesive or glue on the octagonal bottom wall are accessible to the worker. Each of the isosceles triangles are folded inwardly toward a central vertical axis of the sidewall blank and downwardly to contact the octagonal bottom. In the final steps of the construction process of the present invention, the isosceles triangles are secured to the bottom wall by one or more of several methods. The triangles may be secured with glue, adhesive or conventional sewing techniques. Alternatively, a first component of an adhesive may be applied to the bottom and a second component of adhesive applied to the upper portion of the sidewall blank, such that the two-part adhesive forms a bond when the first component and second component come in contact with each other. Once the triangles are secured, the Glue Bottom Bag is formed and is ready for the attachment of optional features such as lift straps or a top wall.

In a second embodiment of the current invention, a continuous circular woven tube is cut perpendicular to its central axis in a sawtooth manner, forming a continuously woven sidewall blank with isosceles triangles along the top. The complementary portion of the circular woven tube from which the sidewall blank was cut may be used as the upper portion of a consecutive sidewall blank.

The continuously woven sidewall blank is attached to a carriage suspended over the octagonal work table by a structural support as was previously described. An octagonal bottom is positioned on the work table beneath the suspended blank. Adhesive or glue is applied to the areas that will come in contact with the continuously woven sidewall blank. The circular woven sidewall blank is lowered into contact with the octagonal bottom and each of the isosceles triangles are secured to the bottom as previously described. Once the triangles are secured, the Glue Bottom Bag is formed and ready for attachment of optional features such as lift straps and/or a top wall.

In a third embodiment, the Glue Bottom Bag has a circular horizontal cross section. A single rectangular sheet is formed into a sidewall blank having an open top and open bottom by bringing the ends together and securing them to each other in a conventional manner. The sidewall blank is attached to a carriage and suspended over a round work table by a structural support as previously described. The work table includes a hole at its center so that an access opening, if any, located in the bottom wall can be accommodated during the construction process.

A round bottom wall is positioned on the work table beneath the suspended sidewall blank. Adhesive or glue is then applied to the bottom wall in areas which will come into contact with the sidewall blank.

Subsequent to placement of the adhesive or glue, the sidewall blank is lowered into contact with the bottom wall. The length of the sidewall blank is then draped down and over the work table so that the upper portion of the sidewall blank which will contact the adhesive or glue on the round bottom wall are accessible to the worker. Fins are formed at regular intervals along the upper portion of the sidewall blank to take up the surplus material created when the upper portion of the cylindrical sidewall blank is folded inwardly into contact with the round bottom. In the final steps of the construction process of the present invention, the fins are folded, cut and/or secured to the bottom wall by one or more of several methods as described above. Once the fins are secured, the Glue Bottom Bag is formed and is ready for the attachment of optional features such as lift straps or a top wall.

In a fourth embodiment of the current invention, a continuous circular woven tube is cut perpendicular to its central axis, forming a continuously woven sidewall blank. The continuously woven sidewall blank is attached to a carriage suspended over the circular work table by a structural support as was previously described. A circular bottom is positioned on the work table beneath the suspended blank. Adhesive or glue is applied to the areas that will come in contact with the continuously woven sidewall blank. The circular woven sidewall blank is lowered into contact with the circular bottom.

Fins are formed at regular intervals along the upper portion of the sidewall blank to take up the surplus material created when the upper portion of the cylindrical sidewall blank is folded inwardly into contact with the round bottom. In the final steps of the construction process of the present invention, the fins are folded, cut and/or secured to the bottom wall by one or more of several methods as described above. Once the fins are secured, the Glue Bottom Bag is formed and is ready for the attachment of optional features such as lift straps or a top wall.

In a fifth embodiment, the Glue Bottom Bag has a square horizontal cross section. A single rectangular sheet is formed into a sidewall blank having an open top and open bottom by bringing the ends together and securing them to each other in a conventional manner. The sidewall blank is attached to a carriage and suspended over a square work table by a structural support as previously described. The work table includes a hole at its center so that an access opening, if any, located in the bottom wall can be accommodated during the construction process.

A square bottom wall is positioned on the work table beneath the suspended sidewall blank. Adhesive or glue is then applied to the bottom wall in areas which will come into contact with the sidewall blank.

Subsequent to placement of the adhesive or glue, the sidewall blank is lowered into contact with the bottom wall. The length of the sidewall blank is then draped down and over the work table so that the upper portion of the sidewall blank which will contact the adhesive or glue on the round bottom wall are accessible to the worker. Fins are formed at regular intervals along the upper portion of the sidewall blank to take up the surplus material created when the upper portion of the cylindrical sidewall blank is folded inwardly into contact with the square bottom. In the final steps of the construction process of the present invention, the fins are folded, cut and/or secured to the bottom wall by one or more of several methods as described above. Once the fins are secured, the Glue Bottom Bag is formed and is ready for the attachment of optional features such as lift straps or a top wall.

In a sixth embodiment of the current invention, a continuous circular woven tube is cut perpendicular to its central axis, forming a continuously woven sidewall blank. The continuously woven sidewall blank is attached to a carriage suspended over the circular work table by a structural support as was previously described. A square bottom is positioned on the work table beneath the suspended blank. Adhesive or glue is applied to the areas that will come in contact with the continuously woven sidewall blank. The square woven sidewall blank is lowered into contact with the circular bottom.

Fins are formed at regular intervals along the upper portion of the sidewall blank to take up the surplus material created when the upper portion of the square sidewall blank is folded inwardly into contact with the round bottom. In the final steps of the construction process of the present invention, the fins are folded, cut and/or secured to the bottom wall by one or more of several methods as described above. Once the fins are secured, the container is formed and is ready for the attachment of optional features such as lift straps or a top wall.

Additionally, according to the present invention a method for construction of a flexible bulk container with a glue top is disclosed. For purposes of this application, a container with a glued top, constructed by one of the three embodiments hereinafter disclosed, shall be referred to as a "Glue Top Bag." For purposes of this application, the term "container blank" means a container having a bottom wall and a sidewall, but lacking a top wall. The container blank may be constructed by one of the aforementioned techniques for securing a bottom wall to the sidewall or by conventional techniques well known in the industry. In this application, when referring to a container blank, the "upper portion of the container sidewall" means the upper most section of the container sidewall when the container is resting upright on its bottom and the open top is up. It is important to distinguish between "upper portion of the container sidewall" when referring to the container blank and the "upper portion of the sidewall blank." In fact, if the container blank is constructed according to the method heretofore disclosed, the upper portion of the sidewall blank is secured to the bottom wall of the container. When the container is turned over and uprighted, the upper portion of the sidewall blank is now the lowermost portion of the container sidewall in the uprighted container blank.

In the seventh embodiment of the present invention, a collapsible work surface is suspended by a rod from a support structure that may be similar in design and construction as the support structure heretofore described for use in the process for manufacturing a Glue Bottom Bag. A first collapsible work surface is constructed similar to a conventional umbrella. A first collar and a second collar are located on the rod and are movable in the axial direction. Plates are hinged to the first collar. Stays are hinged to the plates and the second collar. The plates may be expanded and retracted by a spring loaded mechanism. The collapsible work surface is inserted in a collapsed position through an access opening of a previously manufactured conventional top wall. The work surface and the top wall are lowered into a previously manufactured container blank through the open top. The attached plates are expanded to form a work surface.

The bag top is spread out on the work surface and an adhesive is applied to either the inside surface of the upper portion of the container sidewall and/or the surface of top wall. Alternatively, a first part adhesive may be applied to the inside surface of the upper portion of the container sidewall and a second part adhesive may be applied to the surface of the top wall. The upper portion of the container sidewall is folded over and engages the top wall. The adhesive secures the top wall to the container blank thereby forming the Glue Top Bag. The work surface is collapsed and withdrawn through the access opening in the top wall.

In an eighth embodiment of the present invention, a second work surface comprising a donut-shaped inflatable bag is used. The alternative collapsible work surface is affixed to a rod and is raised or lowered by a conventional hydraulic piston operated by a pressure source and supply lines. Another pressure source supplies pressurized fluid or gas to the inflatable work surface. The work surface may be constructed from any expandable polymeric material including conventional synthetic rubber compounds used in automobile tire inner tubes. The collapsible work surface is inserted in a collapsed position through an access opening of a previously manufactured conventional top wall. The work surface and the top wall are lowered into a previously manufactured container blank through the open top. The pressure source is activated and pressurized fluid or gas is fed through the supply line thereby inflating the work surface in the same manner as a tire inner tube is inflated. The top wall is spread out on the inflated work surface and adhesive is applied to either the inside surface of the upper portion of the container sidewall and/or the surface of the top wall. Alternatively, a first part adhesive may be applied to the inside surface of the upper portion of the container sidewall and a second part adhesive may be applied to the surface of the top wall. The upper portion of the container sidewall is folded over and engages the top wall. The adhesive secures the top wall to the container blank thereby forming a Glue Top Bag. The work surface is collapsed and withdrawn through the access opening in the top wall.

In a ninth embodiment of the present invention, a third work surface is disclosed. The alternative collapsible work surface comprises a standard polymeric tubular liner having a predetermined size and shape when inflated for conforming substantially to the interior size and shape of a container blank. The liner may have one or more access openings. At least one access opening is secured to a pressure source and the other access openings are temporarily sealed. The liner is inserted into the container blank. Pressurized fluid inflates the liner, the top of which forms a work surface.

The top wall is spread out on the inflated work surface and adhesive is applied to either the inside surface of the upper portion of the container sidewall and/or the surface of top wall. Alternatively, a first part adhesive may be applied to the inside surface of the upper portion of the container sidewall and a second part adhesive may be applied to the surface of the top wall. The upper portion of the container sidewall is folded over and engages the top wall. The adhesive secures the top wall to the container blank thereby forming a Glue Top Bag. The pressurized fluid is removed from the liner. However, in this embodiment the liner previously functioning as a Work Surface remains inside the Glue Top Bag and becomes a part thereof.

Various shaped Glue Top Bags, including but not limited to square, round and octagonal may be formed by the method described above. Numerous overlap configurations are possible, including but not limited to the same configurations heretofore described regarding construction of the Glue Bottom Bag.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1:
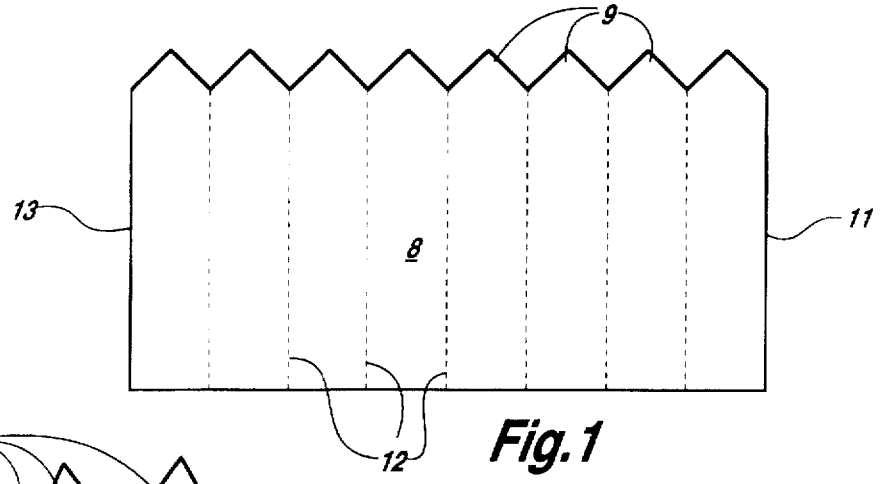
FIG. 1 is a top view, showing a sidewall for a flexible bulk container.

Referring now to FIG. 1, there is shown a plan view of a generally rectangular shaped sheet of material 8 that has the top cut in a saw tooth manner with a series of eight isosceles triangles 9 equally spaced along the top. The location of future fold lines 12 are indicated by dashed lines.

Figure 2:
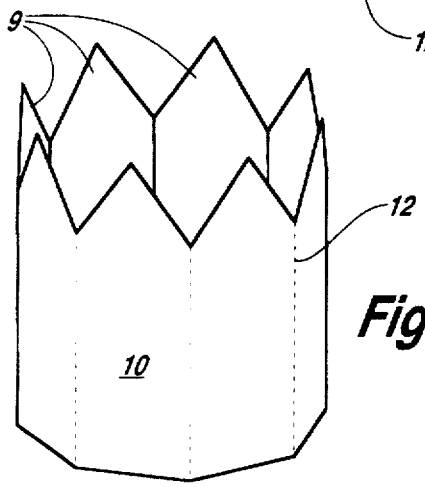
FIG. 2 is a perspective view, showing an octagonal sidewall blank.
Figure 3:
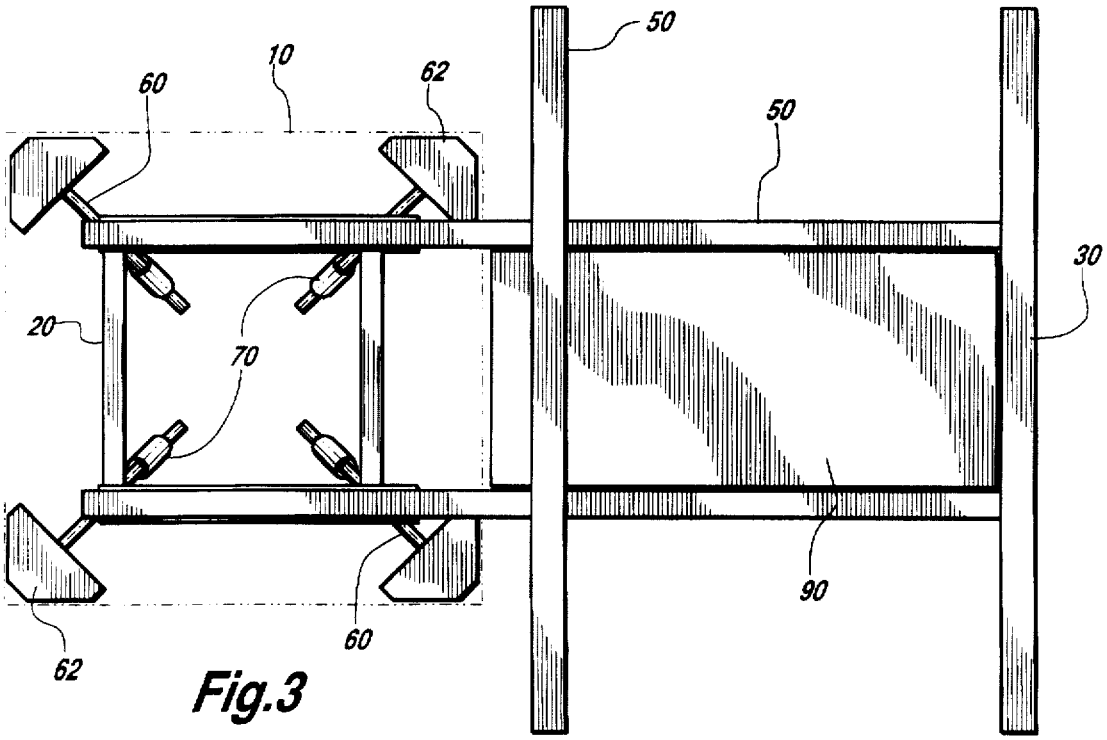
FIG. 3 is a top view showing a support structure and carriage used in the process of manufacturing the invention.
Figure 4:
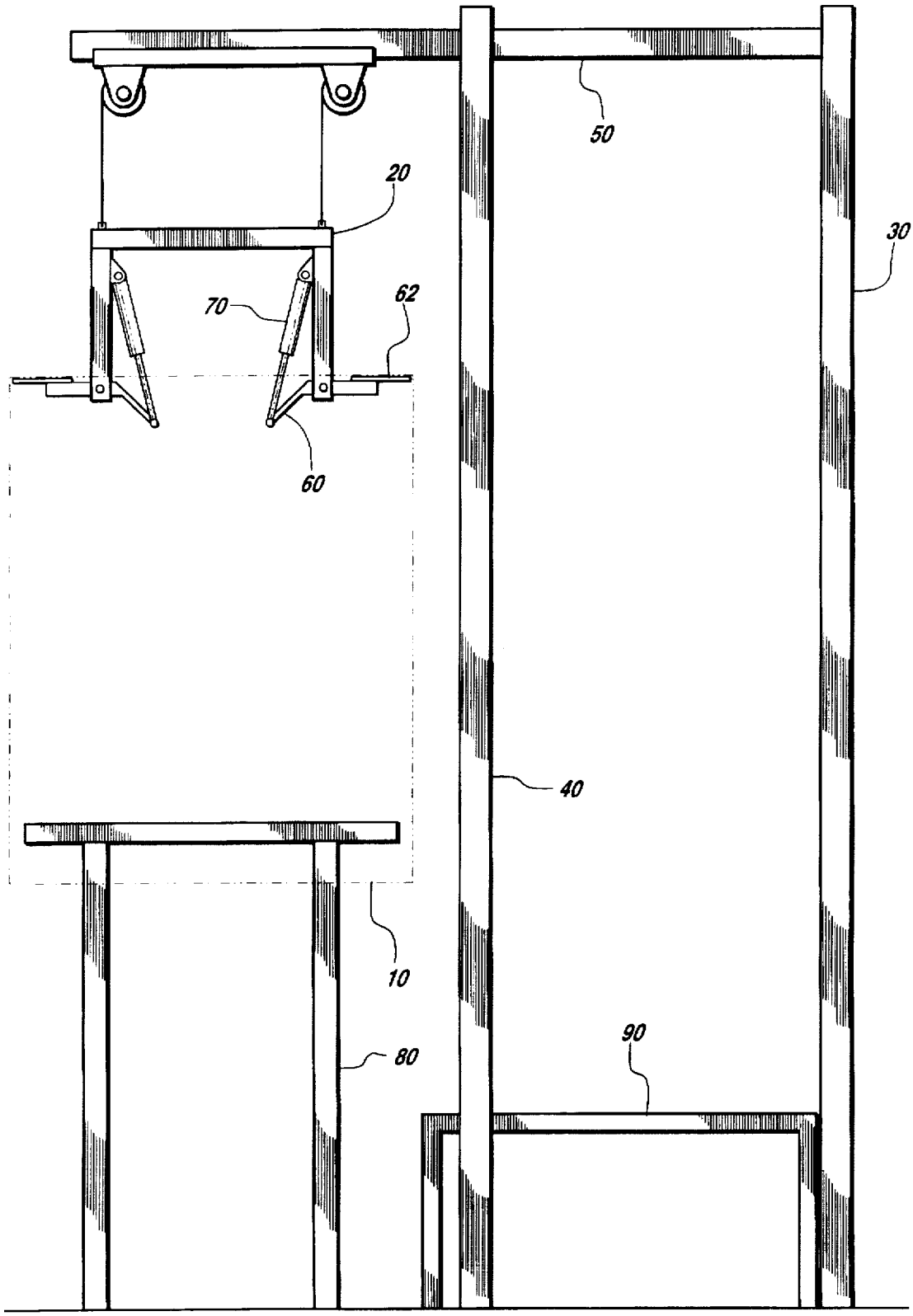
FIG. 4 is a side view showing the support structure and carriage used in the manufacture of the invention.

FIG. 2 displays a sidewall blank 10, constructed from a single rectangular sheet 8 (see FIG. 1). For purposes of this application, a "sidewall blank" means containers lacking a top wall and a bottom wall and constructed from either a single sheet of material or any number of sidewalls secured together, or a circular woven tube. In this application, when referring to a sidewall blank, the "upper portion of the sidewall blank" means the uppermost section of the sidewall when the sidewall blank is vertically upright and viewed from the side. For purposes of this application, the term "Glue Bottom Bag" means a container constructed by one of the six embodiments hereinafter disclosed. Isosceles triangles 9 are positioned along the upper portion of the sidewall blank 10. Referring to FIGS. 1 and 2, sidewall blank 10 has an octagonal horizontal cross section formed by joining ends 11 and 13 of rectangular sheet 8 together and folding along fold lines 12. Referring to FIGS. 3 and 4, once the sidewall blank 10 is formed, it is attached to a carriage 20 of a structural support 30. The structural support 30 is formed of wood, steel or other suitable materials to provide support to the sidewall blank during the instant construction process and to provide optimum placement of the worker in charge of performing the instant construction process. The structural support 30 comprises one or more vertical support members 40 and one or more horizontal support members 50. Attached to one or more of the horizontal support members 50 is the carriage 20. The carriage 20 includes outwardly-movable support arms 60 shaped at their tips 62 to form corners in the sidewall blank 10 when extended. In the first embodiment of the invention, four support arms 60 are used to form the shape of a square. Other embodiments utilize more or less support arms 60 to form other shapes. For example, by using three support arms 60, a triangular shape would be imparted to the sidewall blank 10. FIG. 3 is a top view of the structural support 30 demonstrating a sidewall blank 10 being held by the support arms 60 in a square shape. The support arms 60 function to suspend and hold the sidewall blank 10 open over the work table. It is not necessary that the number of support arms equal the number of sides in a sidewall blank.

Referring again to FIG. 4, the sidewall blank 10 is attached to the carriage 20 by placing the top end of the sidewall blank 10 around, and extending, the support arms 60. The support arms 60 are automatically extended by spring-loaded or hydraulic means 70. Once attached, the carriage 20 is positioned by the worker over a raised work table 80 for the remaining steps of the construction process. The work table 80 is raised to facilitate later steps in the construction process where the length of the sidewall blank 10 is released from the carriage 20 and is draped over the work table 80.

Figure 5:
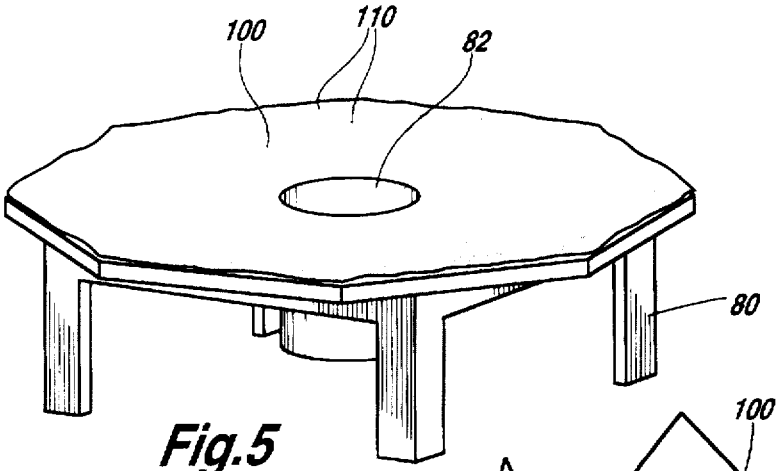
FIG. 5 is a perspective view showing an octagonal work table and octagonal bottom for the Glue Bottom Bag.

Referring to FIG. 5, a hole 82 is included in the surface of the work table 80 to accommodate a access opening, if any, on the bottom wall 100 of the container. The work table will preferably have a horizontal cross section slightly smaller than the cross section of the sidewall blank 10 to allow the lower portion of the sidewall blank 10 to pass over the work table 80. Referring to FIG. 4, beneath the structural support 30 and aligned with the work table 80 is a raised platform 90 for a worker. Standing on the platform 90, a worker can quickly and easily attach the sidewall blank 10 to the carriage 20 and position the sidewall blank 10 over the work table 80.

Referring to FIG. 5, once the sidewall blank 10 is suspended over the work table 80, a bottom wall 100 is positioned on the surface of the work table 80. The hole 82 in the surface of the work table 80 accommodates an access opening, if any, in the bottom wall 100. Next, an adhesive or glue 110 is applied to the upper surface of the bottom wall 100. Although the adhesive or glue 110 is shown to be applied in a generally octagonal pattern along the periphery of the bottom wall 100, any pattern of application can be used, if desired.

Figure 6:
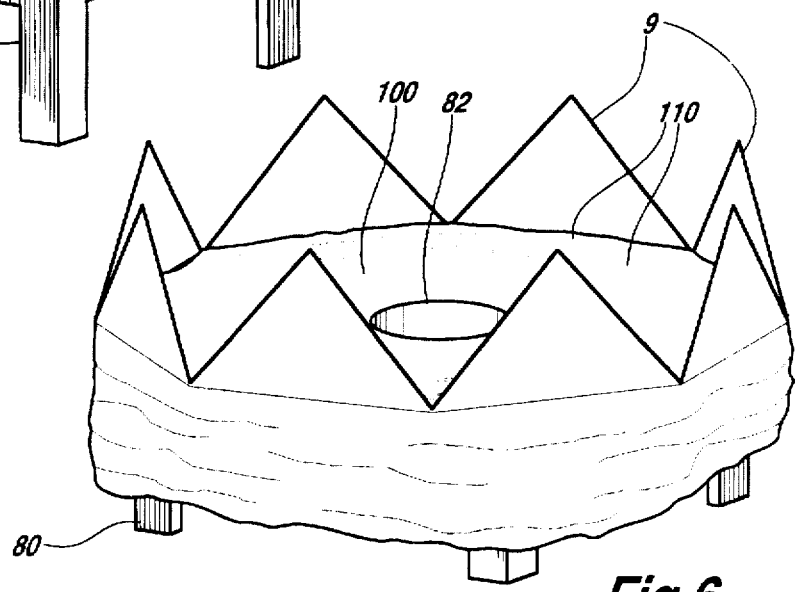
FIG. 6 is a perspective view showing an octagonal sidewall blank draped over the octagonal work table and octagonal bottom wall of FIG. 5.

Now referring to FIG. 6, in the next step of the instant construction process, the sidewall blank 10 is lowered into contact with the bottom wall 100 resting on the work table 80. The sidewall blank 10 is then disconnected from the carriage 20, allowing the remaining length of the sidewall blank 10 to drape down the sides of the work table 80. Each of the isosceles triangles 9 are folded inwardly toward a central vertical axis of the sidewall blank 10 to contact the octagonal bottom 100.

In the final steps of the construction process of the present invention, the isosceles triangles 9 are secured to the bottom 100 by one or more of several methods. The triangles 9 may be secured with glue, adhesive or conventional sewing techniques. Alternatively, a first component of an adhesive may be applied to an upper surface of the bottom wall 100 and a second component of adhesive applied to the top inside of the sidewall blank 10, such that the two-part adhesive forms a bond when the first component and second component come in contact with each other. Once the triangles 9 are secured, the Glue Bottom Bag is formed and is ready for the attachment of optional features such as lift straps or a top wall.

Figure 7:
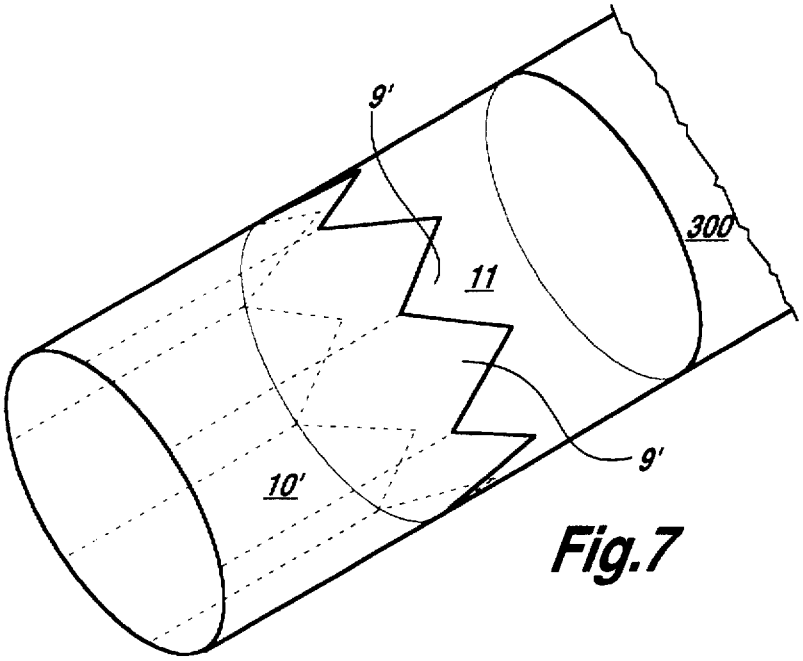
FIG. 7 is a perspective view showing a series of octagonal sidewall blanks cut from a continuously woven circular tube.

Referring to FIG. 7 there is illustrated a second embodiment of the present invention. A continuous circular woven tube 300 is provided directly from a loom or storage. The tube 300 is cut perpendicular to its central axis in a sawtooth manner, forming a continuously woven sidewall blank 10' with isosceles triangles 9' along the top. The complementary portion of the circular woven tube 300 from which the sidewall blank was cut may be used as the upper portion of a consecutive sidewall blank 11.

The continuously woven sidewall blank 10' is attached to a carriage suspended over the octagonal work table by a structural support as was previously described with regard to FIGS. 3 through 6. A bottom wall is positioned on the work table beneath the suspended blank. Adhesive or glue is applied to the areas that will come in contact with the continuously woven sidewall blank. The circular woven sidewall blank is lowered into contact with the bottom wall and each of the isosceles triangles are secured to the bottom as previously described. Once the triangles are secured, the Glue Bottom Bag is formed and ready for attachment of optional features such as lift straps and/or a top wall.

Figure 8:
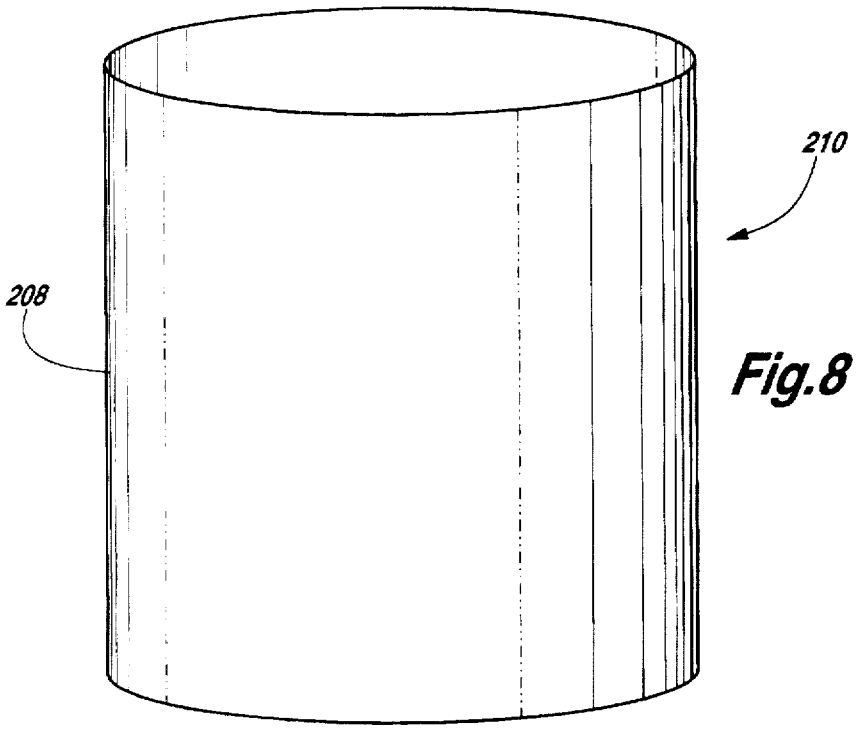
FIG. 8 is a perspective view showing a circular sidewall blank formed by joining opposing ends of a flat panel together.

Referring to FIGS. 8 and 10 through 13, there is illustrated a third embodiment of the present invention. Turning now to FIG. 8, a single rectangular sheet 208 is formed into a cylindrical sidewall blank 210 having an open top and open bottom by bringing the ends together and securing them to each other in a conventional manner. As was previously illustrated in FIGS. 3 and 4, the sidewall blank is attached to a carriage and suspended over a round work table by a structural support.

Figure 10:
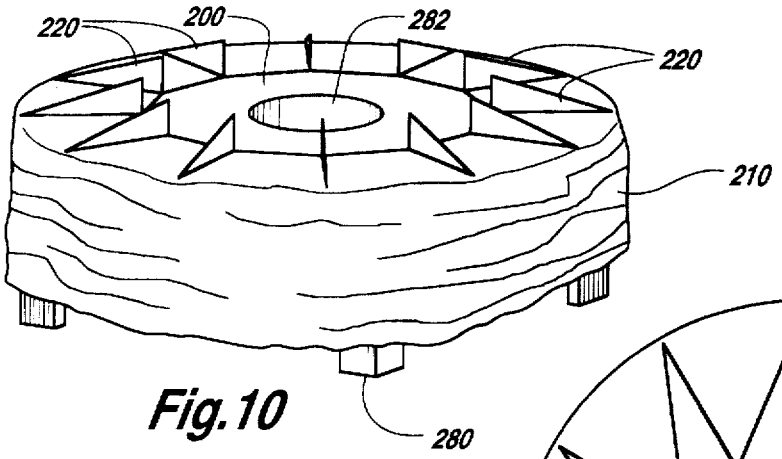
FIG. 10 is a perspective view showing a circular sidewall blank secured to a circular bottom wall resting on a circular work table.

Referring to FIG. 10, a round bottom wall 200 is positioned on a work table 280 beneath the suspended sidewall blank 210. The work table 280 includes a hole 282 at its center so that an access opening, if any, located in the bottom wall 200 can be accommodated during the construction process. Adhesive or glue is then applied to the bottom wall in areas which will come into contact with the sidewall blank 210.

Figure 11:
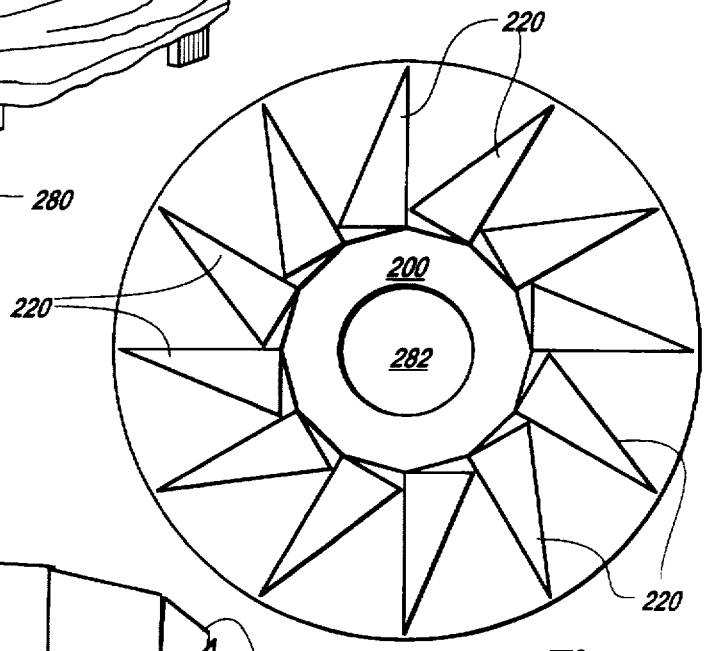
FIG. 11 is a top view showing a circular sidewall blank demonstrating fins of the sidewall blank folded and secured to the bottom wall.

Subsequent to placement of the adhesive or glue, the sidewall blank is lowered into contact with the bottom wall 200. The length of the sidewall blank 210 is then draped down and over the sides of the work table 280 so that the upper portion of the sidewall blank 210 which will contact the adhesive or glue on the round bottom wall 200 are accessible to the worker. Fins 220 are formed at regular intervals along the upper portion of the sidewall blank 210 to take up the surplus material created when the upper portion of the cylindrical sidewall blank 210 is folded inwardly into contact with the round bottom wall 200. Referring to FIG. 11, in the final steps of the construction process of the present invention, the fins 220 are folded, cut and/or secured to the bottom wall 200 by one or more of several methods as described above. Once the fins 220 are secured, the Glue Bottom Bag is formed and is ready for the attachment of optional features such as lift straps or a top wall. The corners of the fins 220 can be pre-sewn to provide additional support. This latter option is particularly helpful in applications where the Glue Bottom Bag will be subjected to elevated temperatures which might cause adhesives and/or glues to soften.

The fins 220 may be folded in different directions (not shown) and secured with adhesive or glue to the bottom wall 200.

Figure 12:
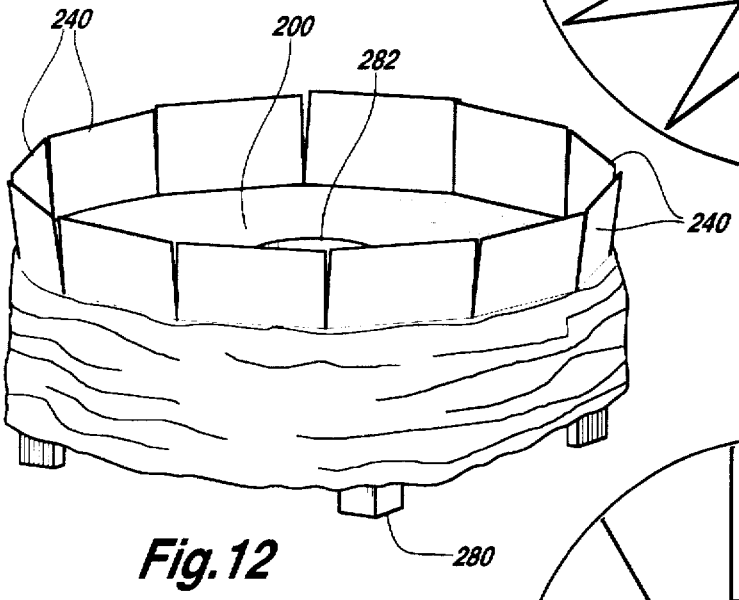
FIGS. 12 and 13 are a perspective view and a top view, respectively, showing a circular sidewall blank with the fins being cut and secured in an alternative manner.
Figure 13:
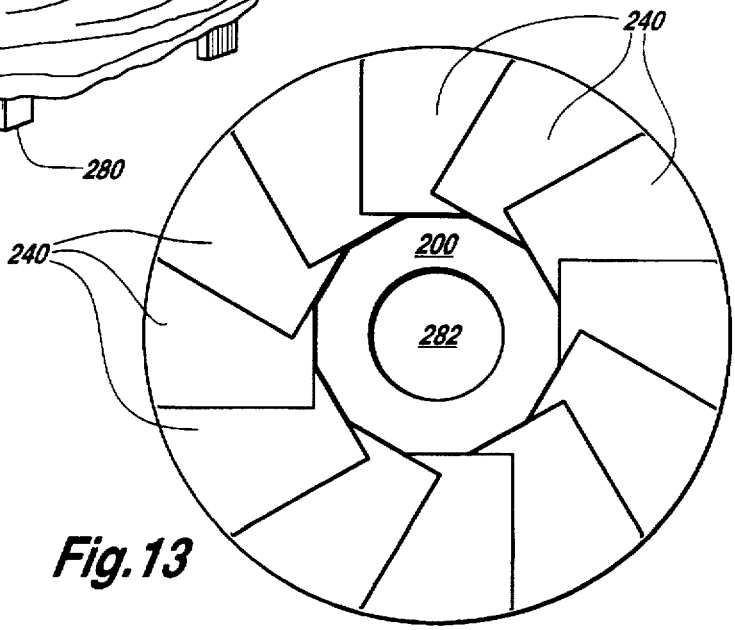

In FIGS. 12 and 13, an alternative step of folding and securing the fins 220 is illustrated. In this embodiment, the upper portion of the sidewall blank 210 is periodically cut to form flaps 240 and flaps 240 are folded over each other and secured to the bottom wall 200.

Figure 9:
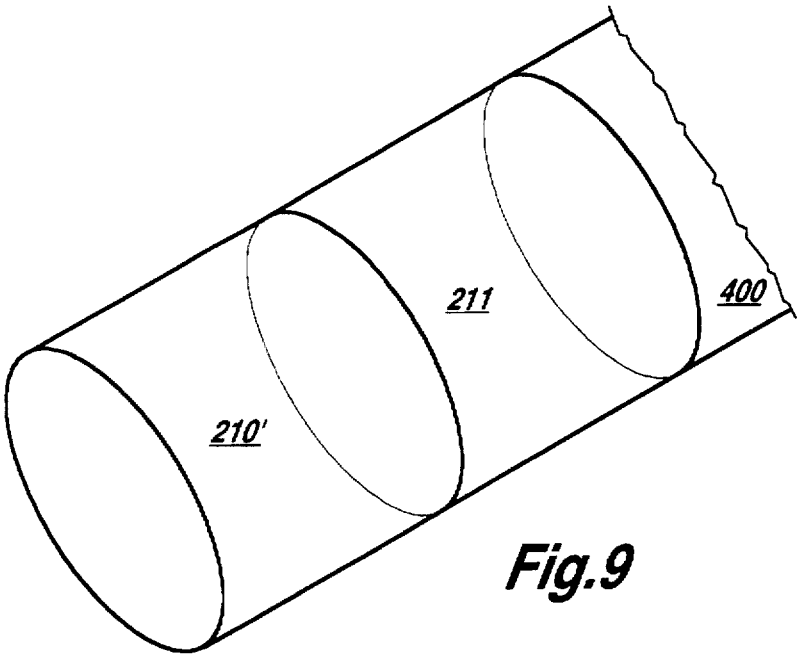
FIG. 9 is a perspective view showing a series of circular sidewall blanks cut from a continuously woven circular tube.

Referring to FIG. 9 there is illustrated a fourth embodiment of the present invention. A continuous circular woven tube 400 is provided directly from the loom or from storage. The tube 400 is cut perpendicular to its central axis, forming a continuously woven sidewall blank 210'. Consecutive continuously woven sidewall blanks 211 are cut from the remaining portion of the circular woven tube 400.

As was previously described with regard to FIGS. 3, 4 and 10 through 13, sidewall blank 210 is attached to a frame and suspended over a round work table by a structural support. A bottom wall 200 is positioned on the work table beneath the suspended blank. Adhesive or glue is applied to the areas that will come in contact with the continuously woven sidewall blank. The sidewall blank is lowered into contact with the bottom wall and secured as previously described. The Glue Bottom Bag is formed and ready for attachment of optional features such as lift straps and/or a top wall.

Referring to FIGS. 14 through 18 there is illustrated a fifth embodiment of the present invention. As was described previously with regards to FIG. 8, a single rectangular sheet is formed into a cylindrical sidewall blank having an open top and open bottom by bringing the ends together and securing them to each other in a conventional manner. Alternatively, four individual panels may be secured together to form the sidewall blank. As was previously described with regards to FIGS. 3 and 4, the sidewall blank is attached to a carriage and suspended over a square work table by a structural support.

Figure 14:
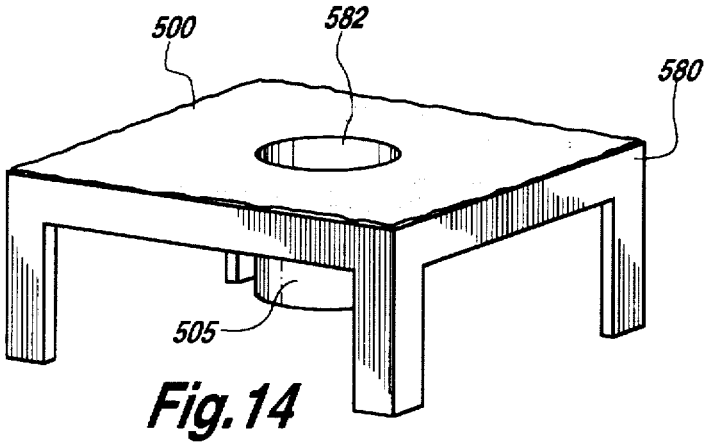
FIG. 14 is a perspective view showing a square work table and square bottom for the flexible bulk container.
Figure 15:
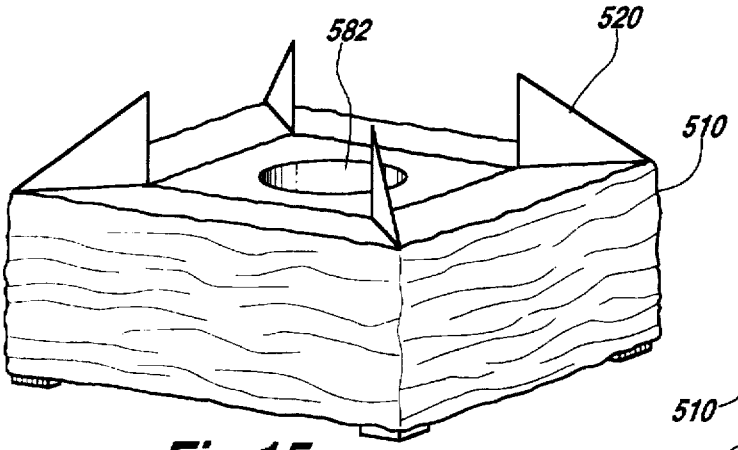
FIG. 15 is a perspective view showing a square sidewall blank secured to a square bottom wall resting on a square work table.

Referring to FIGS. 14 and 15, a square bottom wall 500 is positioned on a work table 580 beneath the suspended sidewall blank 510. The work table 580 includes a hole 582 at its center so that an access opening 505, if any, located in the bottom wall 500 can be accommodated during the construction process. Adhesive or glue is then applied to the bottom wall in areas which will come into contact with the sidewall blank 510.

Subsequent to placement of the adhesive or glue, the sidewall blank 510 is lowered into contact with the bottom wall 500. The length of the sidewall blank 510 is then draped down and over the sides of the work table 580 so that the upper portion of the sidewall blank 510 which will contact the adhesive or glue on the square bottom wall 500 are accessible to the worker. Fins 520 are formed at the corners along the upper portion of the sidewall blank 510 to take up the surplus material created when the upper portion of the cylindrical sidewall blank 510 is folded inwardly into contact with the square bottom wall 500.

Figure 16:
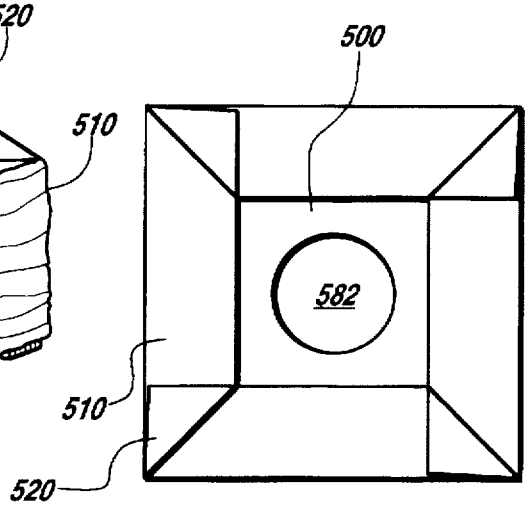
FIGS. 16, 17 and 18 are top views showing a square sidewall blank with fins being secured to a square bottom in alternative manners.
Figure 17:
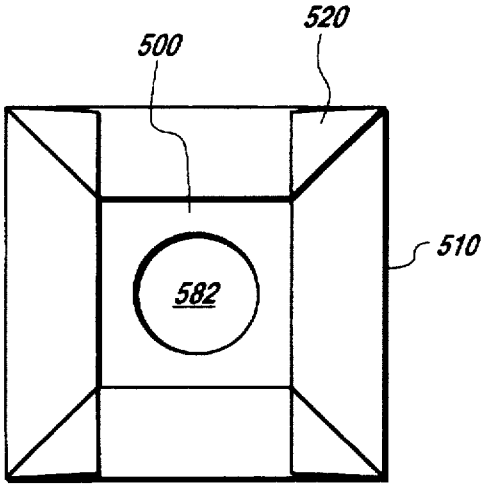
Figure 18:
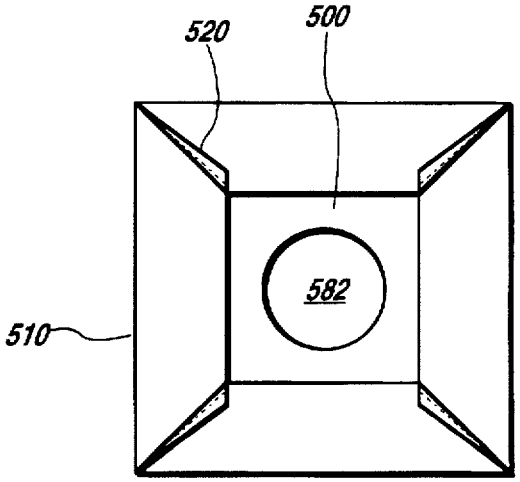

Referring to FIGS. 16 through 18, in the final steps of the construction process of the present invention, the fins 520 are folded, cut and/or secured to the bottom wall 500 by one or more of several methods as described above. The fins 520 may be folded in different directions and secured with adhesive or glue to the bottom wall 500. Once the fins 520 are secured, the Glue Bottom Bag is formed and is ready for the attachment of optional features such as lift straps or a top wall. As is illustrated in FIG. 18, the corners of the fins 520 can be pre-sewn to provide additional support. This latter option is particularly helpful in applications where the Glue Bottom Bag will be subjected to elevated temperatures which might cause adhesives and/or glues to soften.

Figure 19:
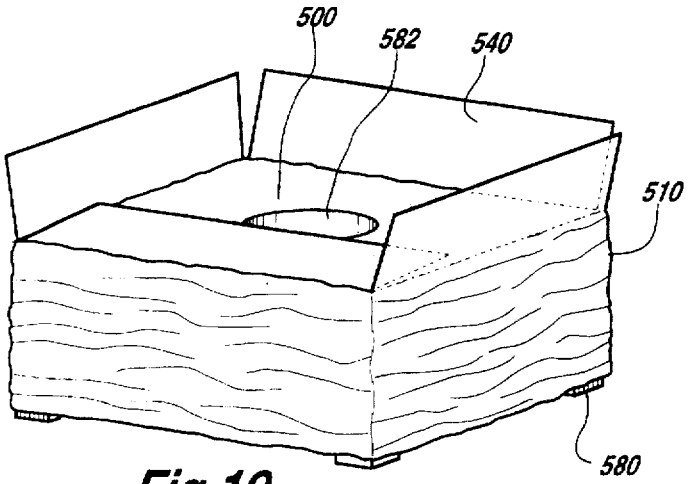
FIGS. 19 and 20 are a perspective view and a top view, respectively, showing a square sidewall blank with the fins being cut and secured to a square bottom in an alternative manner.
Figure 20:
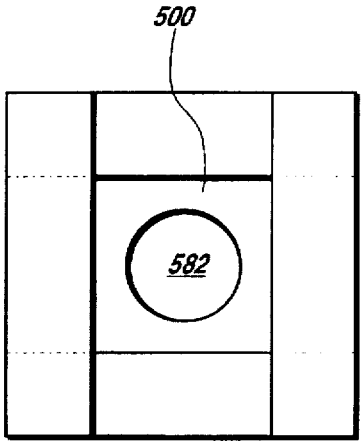

In FIGS. 19 and 20, an alternative step of folding and securing the fins 520 is illustrated. In this embodiment, the upper portion of the sidewall blank 510 is periodically cut to form flaps 540. Flaps 540 are folded over each other and secured to the bottom wall 500.

A sixth embodiment of the invention may be constructed by using a continuously woven circular sidewall blank as illustrated in FIG. 9. A continuous circular woven tube is provide directly from the loom or from storage. The tube is cut perpendicular to its central axis, forming a continuously woven sidewall blank. Consecutive continuously woven sidewall blanks are cut from the remaining portion of the circular woven tube.

As was previously illustrated in FIGS. 3 and 4 the continuously woven sidewall blank is attached to a frame and suspended over a square work table by a structural support. As was illustrated in FIGS. 14–20, a square bottom wall is positioned on the work table beneath the suspended blank. Adhesive or glue is applied to the areas that will come in contact with the continuously woven sidewall blank. The circular woven sidewall blank is lowered into contact with the bottom wall and secured as previously described. The Glue Bottom Bag is formed and ready for attachment of optional features such as lift straps and/or a top wall.

FIGS. 21–30 disclose a method for gluing a top in a flexible bulk container. For purposes of this application, a container constructed by one of the three embodiments disclosed for the glue top manufacturing process is referred to as a "Glue Top Bag." For purposes of this application, "container blank" means an open top flexible bulk container. The top is glued into a "container blank" 1000 manufactured according to steps disclosed in FIGS. 1–20 and the accompanying text or in any conventional manner well known in the art. In this application, when referring to a container blank, the "upper portion of the container sidewall" means the upper most section of the container sidewall when the container is resting upright on its bottom and the open top is up. It is important to distinguish between "upper portion of the container sidewall" when referring to the container blank and the "upper portion of the sidewall blank." In fact, if the container blank is constructed according to the method heretofore disclosed, the upper portion of the sidewall blank is secured to the bottom wall of the container. When the container is turned over and uprighted the upper portion of the sidewall blank is now the lowermost portion of the sidewall in the uprighted container blank.

Figure 21:
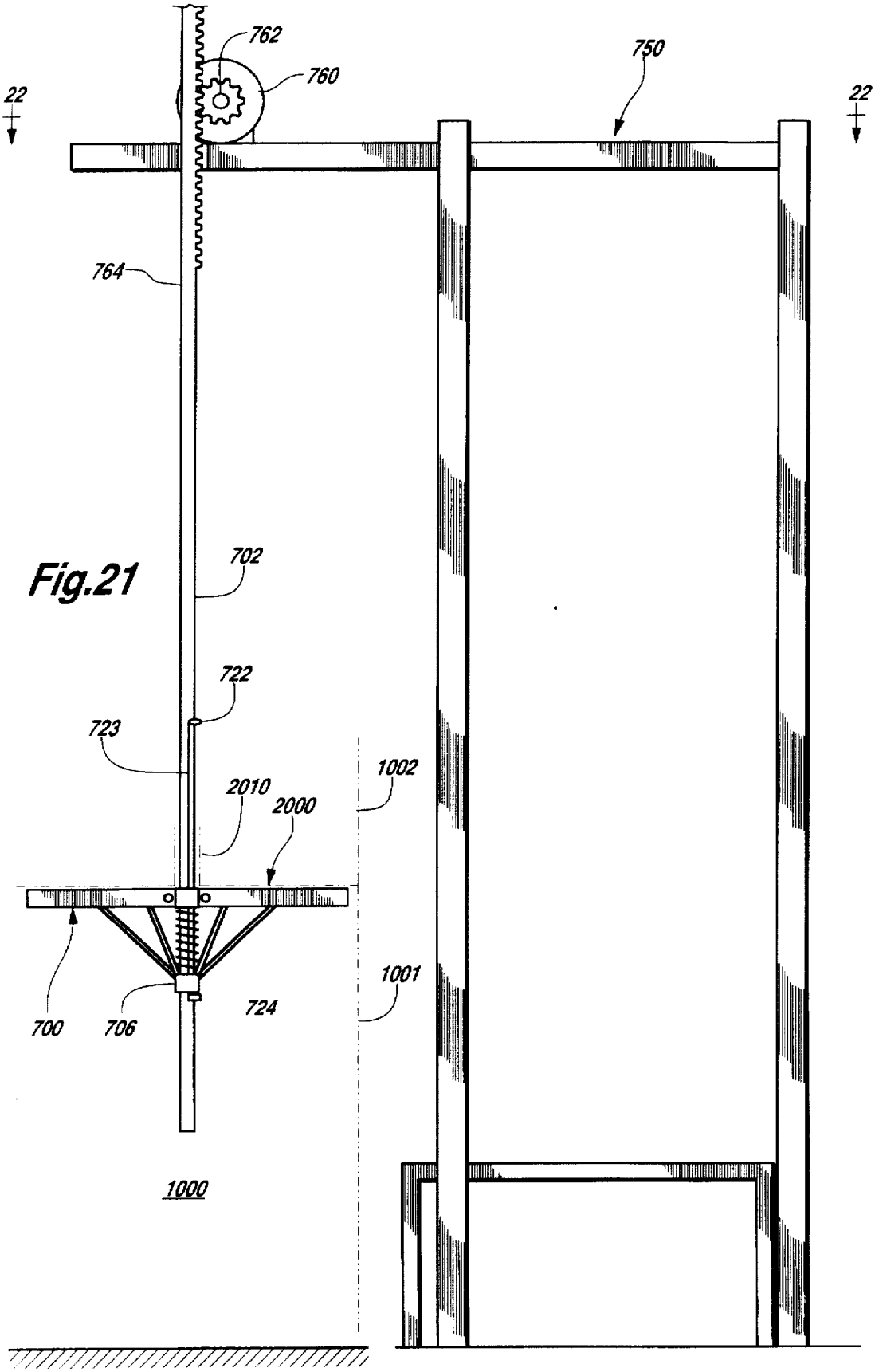
FIGS. 21 and 22 are a side view and top view, respectively, showing a support structure, carriage and the collapsible work surface used in the process of manufacturing a Glue Top Bag.
Figure 22:
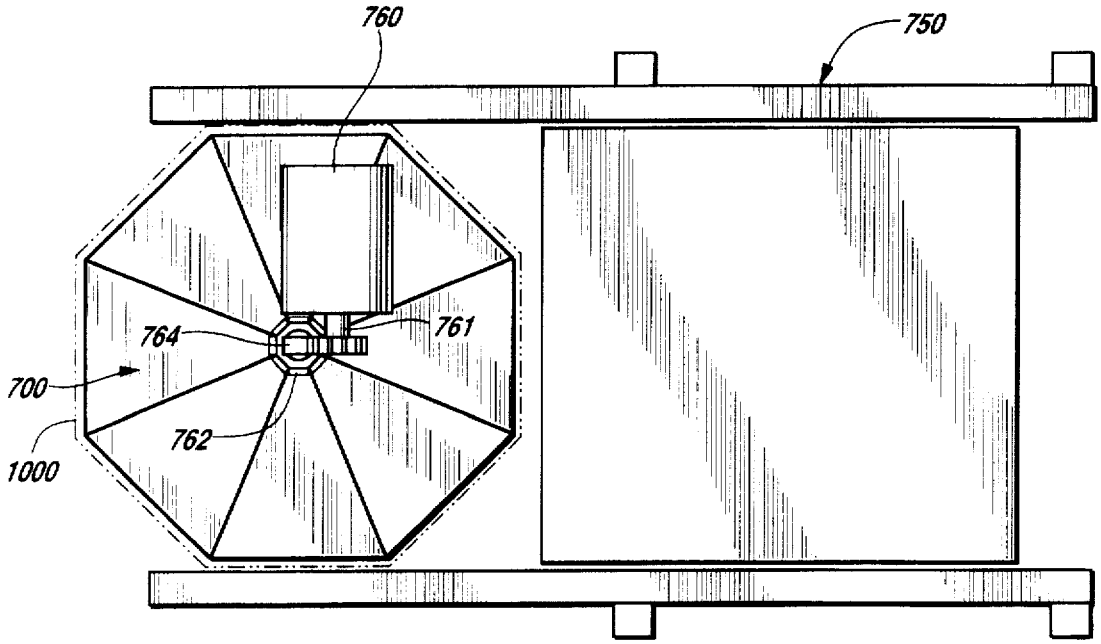

Referring to FIGS. 21 and 22 a first embodiment of a collapsible work surface 700 is disclosed. The collapsible work surface 700 is suspended by a rod 702 from a support structure 750 that may be similar in design and construction to the support structure heretofore described in FIGS. 3 and 4 for use in the process for manufacturing a Glue Bottom Bag. The collapsible work surface 700 is raised or lowered by a conventional rack 764 and pinion gear mechanism 762 driven by a motor 760 and drive shaft 761.

Figure 25:
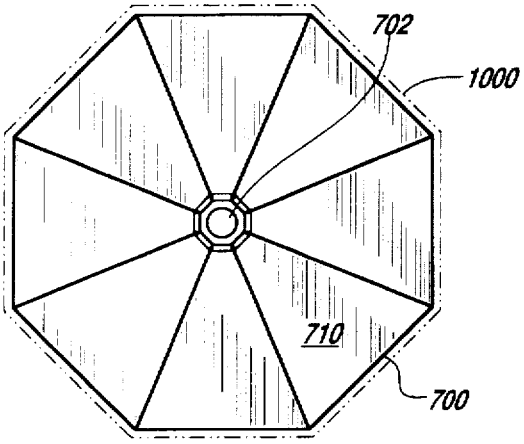
FIGS. 25 and 26 are a top view and side view, respectively, of a collapsible work surface used in the manufacture of a Glue Top Bag.
Figure 26:
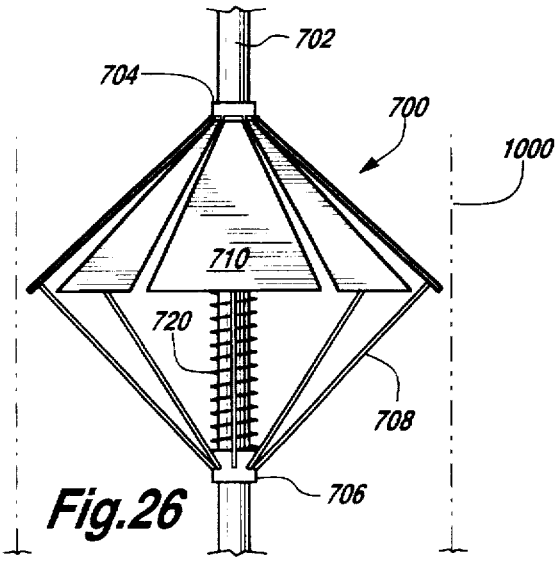

Referring now to FIGS. 25 and 26, the collapsible work surface 700 of FIGS. 21 and 22 is disclosed in more detail. The collapsible work surface is constructed similar to a conventional umbrella. A first collar 704 and a second collar 706 are located on the rod 702 and are movable in the axial direction. Plates 710 are hinged to the first collar 704. Stays 708 are hinged to the plates 710 and the second collar 706. The plates 710 may be expanded and retracted by a spring loaded mechanism. The spring loaded mechanism may comprise a conventional coil spring 720 and a conventional latch mechanism. The latch mechanism (shown in FIG. 21) includes a manually operated tab 722 a connector rod 723 located inside the rod 702.

Referring now to FIGS. 21, 22, 25 and 26, collapsible work surface 700 is inserted in a collapsed position through an access opening 2010 of a previously manufactured conventional top wall 2000. The rod 702 lowers the work surface 700 and the top wall 2000 into a previously manufactured container blank 1000 through the open top. The latch tab 722 is depressed, retracting latch 724, allowing the coil spring 720 to raise the collar 706, the attached stays 708 and plates 710 into an expanded position. The rack and pinion gear 764 and 762 raise or lower the work surface until a predetermined overlap 1002 from the upper portion of the container sidewall 1001 is obtained. A top wall 2000 is spread out on work surface 700 and an adhesive is applied to either the inside surface of the upper portion of the container sidewall 1002 and/or the surface of top wall 2000. Alternatively, a first part adhesive may be applied to the inside surface of the upper portion of the container sidewall 1002 and a second part adhesive may be applied to the surface of the top wall 2000. The upper portion of the container sidewall 1002 is folded over and engages the top wall 2000. The adhesive secures the top wall 2000 to the container blank 1000 thereby forming the Glue Top Bag. The work surface 700 is collapsed and withdrawn through the access opening 2010 in the top wall.

Figure 24:
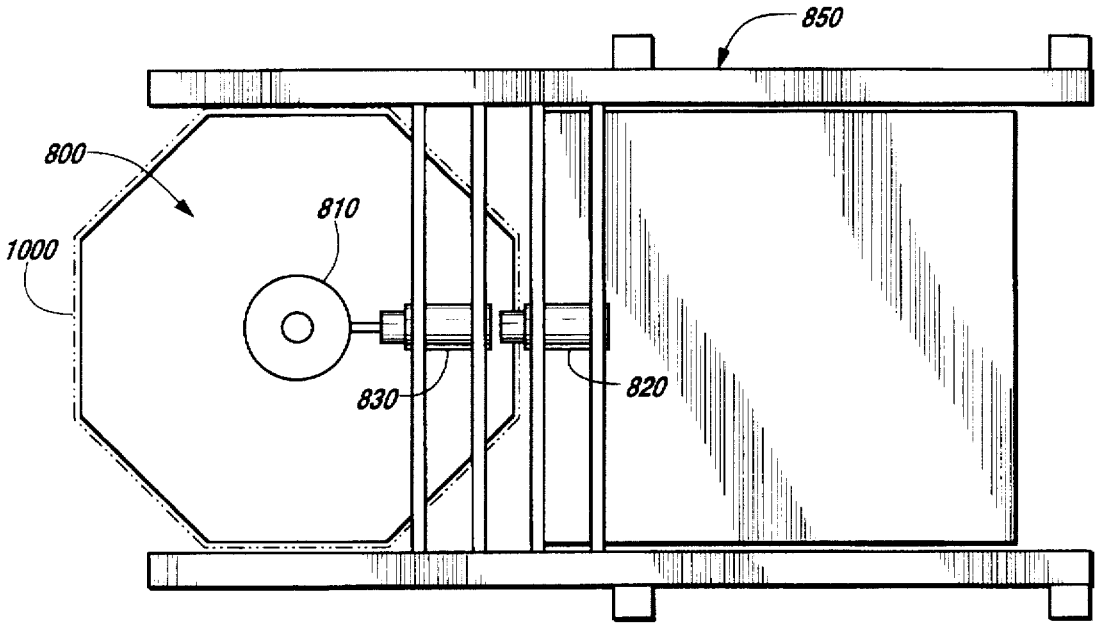
FIGS. 23 and 24 are a side view and top view, respectively, showing the support structure, carriage and an alternative collapsible work surface used in the manufacture of a Glue Top Bag.
Figure 23:
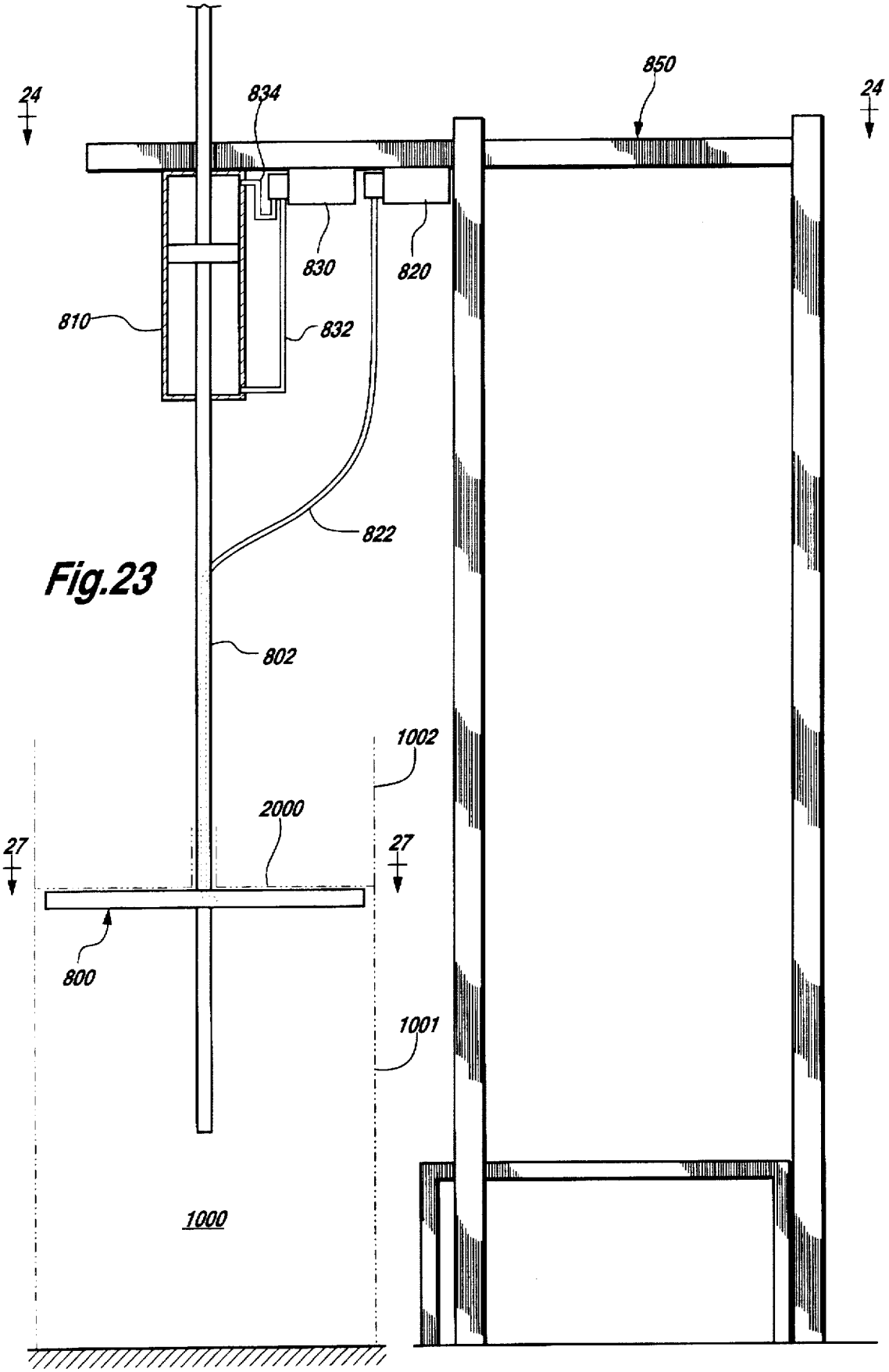

Referring to FIGS. 23 and 24 a second embodiment of a collapsible work surface 800 is disclosed. A collapsible work surface 800 is suspended by a rod 702 from a support structure 850 that may be similar in design and construction as the support structure heretofore described in FIGS. 3 and 4 for use in the process for manufacturing a Glue Bottom Bag. The collapsible work surface 800 is raised or lowered by a conventional hydraulic piston 810 operated by a pressure source 830 and supply line 832 and return line 834. A pressure source 820 and supply line 822 supply pressurized fluid or gas to the inflatable work surface 800. The pressure supply sources 820 and 830 may be either conventional hydraulic fluid pumps or compressors.

Figure 27:
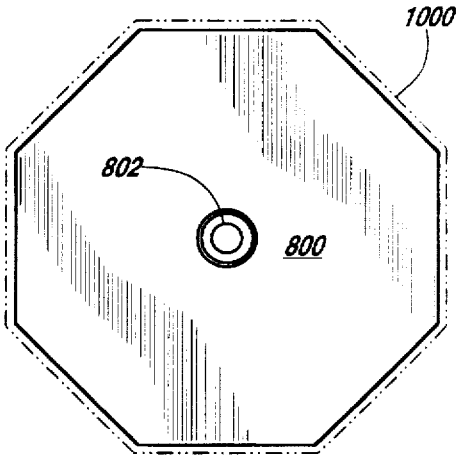
FIGS. 27 and 28 are a top view and side view, respectively, of an alternative collapsible work surface used in the manufacture of a Glue Top Bag.
Figure 28:
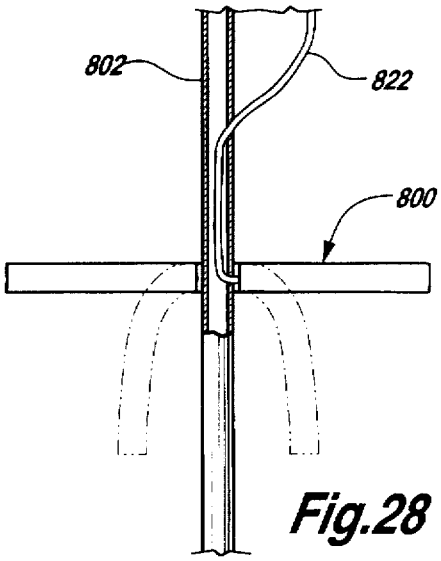

Referring now to FIGS. 27 and 28, the collapsible work surface 800 of FIGS. 23 and 24 is disclosed in more detail. The collapsible work surface 800 is an inflatable donut-shaped bag positioned around and affixed to the support rod 802. The work surface 800 may be constructed from any expandable polymeric material including conventional synthetic rubber compounds used in automobile tire inner tubes. The pressure source 820 and supply line 822 supply pressurized fluid or gas to the inflatable work surface 800.

Referring now to FIGS. 21, 22, 25 and 26, the collapsible work surface 800 is inserted in a collapsed position through an access opening 2010 of a previously manufactured conventional top wall 2000. The rod 702 lowers the work surface 800 and the top wall 2000 into a previously manufactured container blank 1000 through the open top. The pressure source 820 is activated and pressurized fluid or gas is fed through the supply line 822 and down the rod 802 thereby inflating the work surface 800 in the same manner as a tire innertube is inflated. The pressure source 830 via the piston 810 raises or lowers the work surface until a predetermined overlap 1002 from the upper portion of the container sidewall 1001 is obtained. The top wall 2000 is spread out on the inflated work surface 800 and adhesive is applied to either the inside surface of the upper portion of the container sidewall 1002 and/or the surface of the top wall 2000. Alternatively, a first part adhesive may be applied to the inside surface of the upper portion of the container sidewall 1002 and a second part adhesive may be applied to the surface of top wall 2000. The upper portion of the container sidewall 1002 is folded over and engages the top wall 2000. The adhesive secures the top wall 2000 to the container blank 1000 thereby forming a Glue Top Bag. Pressure is released from the inflatable work surface thereby collapsing the work surface. The collapsed work surface 800 is withdrawn through the access opening 2010 in the top wall.

Figure 29:
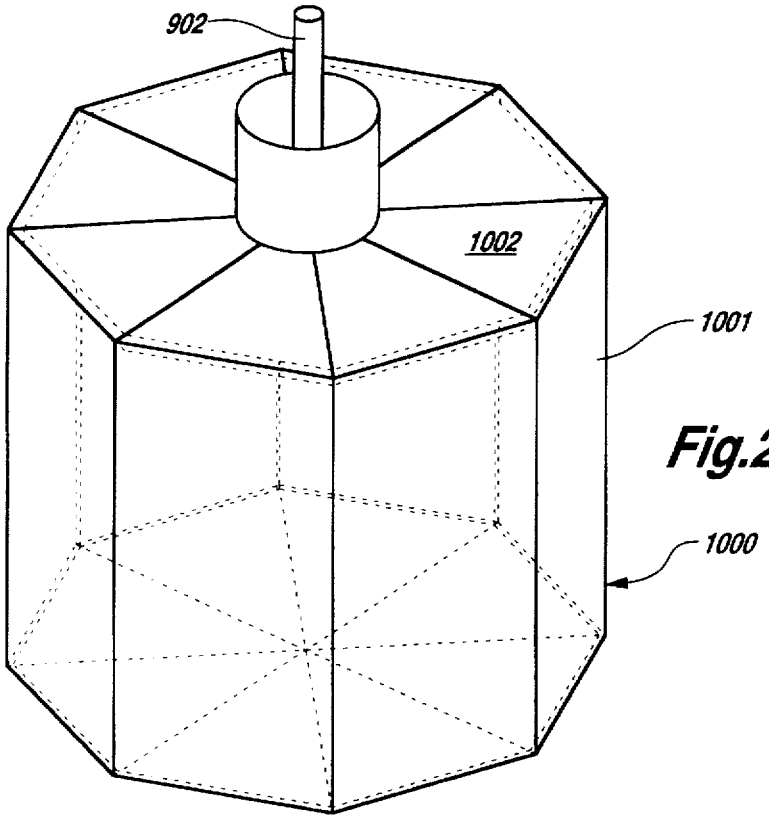
FIGS. 29 and 30 are a perspective view and side view, respectively, of a tubular liner inserted inside a flexible bulk container, wherein the inflated liner serves as a collapsible work surface used in the manufacture of a Glue Top Bag.
Figure 30:
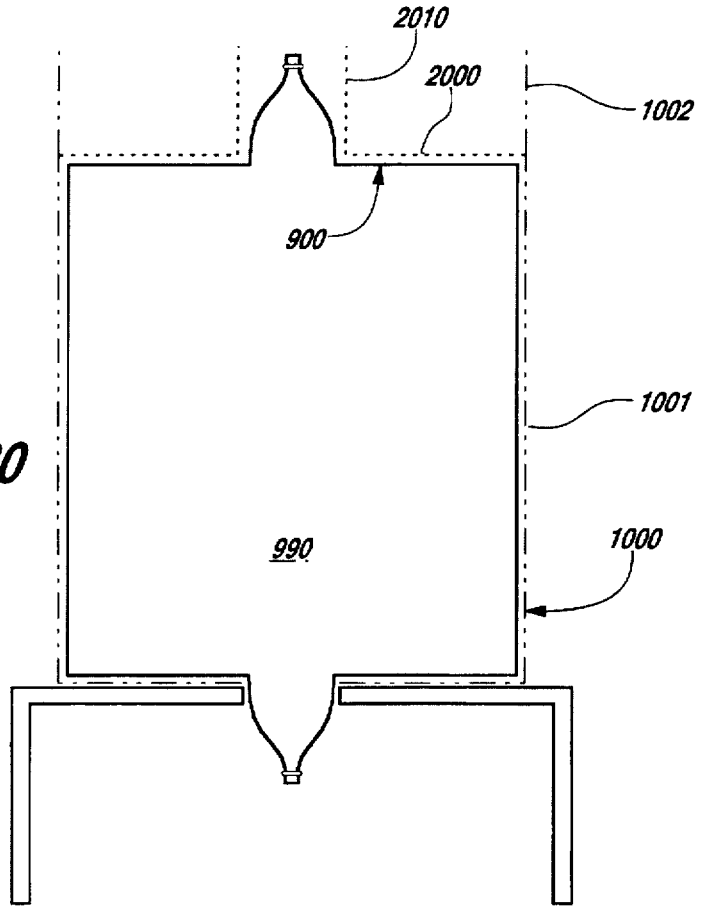

Referring to FIGS. 29 and 30, a third embodiment of a collapsible work surface 900 is disclosed. A collapsible work surface 900 comprises the top wall of a standard polymeric tubular liner 990, commonly used and known in the industry, having a predetermined size and shape when inflated for conforming substantially to the size and shape of a container blank 1000. The liner 990 may have one or more access openings. At least one access opening is secured to a pressure source and the other access openings are temporarily sealed. The liner 990 is inserted into the container blank 1000. Pressurized fluid, typically air, inflates the liner 990, the upper portion of which forms a work surface 900. Pressure supply sources may be either conventional pumps or compressors.

A top wall 2000 is spread out on the work surface 900 and adhesive is applied to either the inside surface of the overlap 1002 formed from an upper portion of container sidewall 1001 and/or the surface of the top wall 2000. Alternatively, a first part adhesive may be applied to the inside surface of the upper portion of the container sidewall 1002 and a second part adhesive may be applied to the surface of the top wall 2000. The upper portion 1002 of the container sidewall 1001 is folded over and engages the top wall 2000. The adhesive secures the top wall 2000 to the container blank 1000 thereby forming a Glue Top Bag. The pressurized fluid is removed from the liner. However, in this embodiment the liner, formerly functioning as a work surface, remains inside the Glue Top Bag and becomes a part thereof.

Various shaped Glue Top Bags, including but not limited to square, round and octagonal, may be formed by the method described above. Numerous overlap configurations are possible including, but not limited to, the same configurations described in FIGS. 5, 6, 10–20 and the accompanying specification text.

Embodiments for Glued Top Bags and/or Glued Bottom Bags having octagonal, circular and square cross sections have been disclosed; however, it is understood that any number of potential cross sectional shapes may be used to form flexible bulk containers by the methods disclosed. It should be understood that the invention is not limited to the embodiments disclosed, but is intended to embrace any alternative, modifications, rearrangements or substitutes of parts or elements as fall within the spirit and scope of the invention.

I claim:

1. A method of manufacturing a flexible bulk container having a sidewall and bottom wall, said method comprising the steps of:

(a) providing a sidewall blank having a predetermined hollow tubular configuration and comprising an upper portion, a lower portion, an inside surface and an outside surface;

(b) providing a bottom wall having a predetermined shape corresponding to the shape of the sidewall blank;

(c) placing the bottom wall on a work surface;

(d) locating the sidewall blank with respect to the work surface with the lower portion of the sidewall blank positioned below the work surface and the upper portion of the sidewall blank positioned above the work surface; and (e) subsequent to steps (a) through (d), securing the sidewall blank to the bottom wall by folding the upper portion of the sidewall blank over the bottom wall and engaging the inside surface of the sidewall blank with adhesive located between the bottom wall and the inside surface of the sidewall blank.

2. The method of manufacturing the flexible bulk container of claim 1 wherein said work surface is raised and has a cross-sectional size and shape slightly smaller than the size and shape of the bottom wall.

3. A method of manufacturing a flexible bulk container having a sidewall and bottom wall, said method comprising the steps of:

(a) providing a sidewall blank having a predetermined hollow tubular configuration and comprising an upper portion, a lower portion, an inside surface and an outside surface;

(b) providing a bottom wall having a predetermined shape corresponding to the shape of the sidewall blank;

(c) placing the bottom wall on a work surface;

(d) locating the sidewall blank with respect to the work surface with the lower portion of the sidewall blank positioned below the work surface and the upper portion of the sidewall blank positioned above the work surface;

(e) forming fins from the upper portion of the sidewall blank;

(f) subsequent to steps (a) through (e), securing the sidewall blank to the bottom wall by folding the upper portion of the sidewall blank over the bottom wall and engaging the inside surface of the sidewall blank with adhesive located between the bottom wall and the inside surface of the sidewall blank; and (h) securing the fins to the outside of the folded over upper portion of the sidewall blank.

4. The method of manufacturing the flexible bulk container of claim 3 wherein said method further includes pre-sewing the fins prior to securing the sidewall blank to the bottom wall.

* * * * *